US009352901B2

(12) United States Patent
Furrow

(10) Patent No.: US 9,352,901 B2
(45) Date of Patent: May 31, 2016

(54) DEVICE FOR USE IN BEVERAGE CONTAINERS

(71) Applicant: Son-Cliff Inc., Puyallup, WA (US)

(72) Inventor: Marvin Cliff Furrow, Las Vegas, NV (US)

(73) Assignee: Sacar Inc., Puyallup, WA (US)

( * ) Notice: Subject to any disclaimer, the term of this patent is extended or adjusted under 35 U.S.C. 154(b) by 0 days.

(21) Appl. No.: 13/829,851

(22) Filed: Mar. 14, 2013

(65) Prior Publication Data

US 2014/0099423 A1 Apr. 10, 2014

Related U.S. Application Data

(60) Provisional application No. 61/638,372, filed on Apr. 25, 2012.

(51) Int. Cl.

| | |
|---|---|
| ***A47G 19/22*** | (2006.01) |
| ***B65D 85/72*** | (2006.01) |
| *A47G 21/18* | (2006.01) |

(52) U.S. Cl.

CPC ..... *B65D 85/72* (2013.01); *A47G 19/2222* (2013.01); *A47G 21/18* (2013.01); *A47G 21/188* (2013.01)

(58) Field of Classification Search

CPC ..... A47G 12/2211; A47G 19/2222; A47G 21/18; A47G 21/188; A47J 31/20; B65D 25/04; B65D 85/72

USPC ..... 220/705, 706, 709, 719, 639, 703, 694, 220/501, 503, 505, 529, 528; 426/590, 85

See application file for complete search history.

(56) References Cited

U.S. PATENT DOCUMENTS

| | | | | | |
|---|---|---|---|---|---|
| 1,243,033 | A | * | 10/1917 | Beatty | 215/326 |
| 1,847,879 | A | * | 3/1932 | Knecht | 239/33 |
| 2,357,063 | A | * | 8/1944 | Swing | 210/469 |
| 2,753,050 | A | * | 7/1956 | Langston | 210/469 |
| 3,040,897 | A | * | 6/1962 | Holman | 210/244 |
| 4,020,532 | A | * | 5/1977 | Lichter | 24/562 |
| 4,183,175 | A | * | 1/1980 | Magee | 47/79 |
| 4,494,668 | A | * | 1/1985 | Lottick | 220/709 |
| 4,723,674 | A | * | 2/1988 | Nunes | 215/231 |
| 4,938,375 | A | * | 7/1990 | Fantacone | 220/709 |

(Continued)

FOREIGN PATENT DOCUMENTS

| | | |
|---|---|---|
| JP | 11-266988 | 10/1999 |
| JP | 2007-296307 | 11/2007 |

(Continued)

*Primary Examiner* — Fenn Mathew
*Assistant Examiner* — Don M Anderson
(74) *Attorney, Agent, or Firm* — George C. Rondeau, Jr.; Davis Wright Tremaine LLP

(57) ABSTRACT

Systems and methods for isolating a bottom open end of a drinking straw from objects, such as fruit, leaves, seeds, etc., located within a beverage container. A sieve is disclosed that has outer dimensions that substantially match inner dimensions of a bottom portion of a drinking glass. The sieve includes a top platform having a drinking straw opening and a plurality of filter openings sized to permit liquid to pass therethrough while preventing passage by objects. The bottom open end of the drinking straw is positionable within a cavity of the sieve that is isolated from the objects, such that a user may consume the beverage through the drinking straw without the objects obstructing the drinking straw.

17 Claims, 8 Drawing Sheets

(56) References Cited

U.S. PATENT DOCUMENTS

| | | | | |
|---|---|---|---|---|
| 5,105,975 | A * | 4/1992 | Patterson | 220/709 |
| D345,889 | S * | 4/1994 | Herricks | D7/396.2 |
| 5,381,924 | A * | 1/1995 | Kiefel | 220/709 |
| 5,727,712 | A * | 3/1998 | Costello | 220/703 |
| 5,802,956 | A * | 9/1998 | Robertson et al. | 99/276 |
| 5,860,558 | A * | 1/1999 | Fahy | 220/719 |
| 5,921,025 | A * | 7/1999 | Smith | A01G 9/02 47/48.5 |
| 5,971,202 | A * | 10/1999 | Filbrun | 220/719 |
| 5,979,299 | A * | 11/1999 | Hornsby et al. | 99/297 |
| 6,561,078 | B1 * | 5/2003 | Hughes | 99/277 |
| 6,588,622 | B1 * | 7/2003 | Leishman et al. | 220/719 |
| 7,017,768 | B2 * | 3/2006 | Iskierka | 220/216 |
| 7,093,531 | B2 * | 8/2006 | Tardif | 99/297 |
| 7,213,507 | B2 * | 5/2007 | Glucksman et al. | 99/297 |
| 7,337,705 | B1 * | 3/2008 | Catena et al. | 99/297 |
| 7,909,176 | B2 * | 3/2011 | Merino | 210/459 |
| 8,033,420 | B2 * | 10/2011 | Roseblade et al. | 220/731 |
| 8,459,492 | B2 * | 6/2013 | Merino | 220/705 |
| 8,485,383 | B2 * | 7/2013 | Taufer | 220/500 |
| 2003/0070979 | A1 * | 4/2003 | Huang | 210/469 |
| 2004/0118769 | A1 * | 6/2004 | Merino | 210/459 |
| 2006/0163251 | A1 * | 7/2006 | Kelstrom et al. | 220/253 |
| 2006/0175248 | A1 * | 8/2006 | Raimondo et al. | 210/497.01 |
| 2012/0104741 | A1 * | 5/2012 | Brewster et al. | 283/67 |

FOREIGN PATENT DOCUMENTS

| | | |
|---|---|---|
| KR | 20-0383573 | 5/2005 |
| WO | 92-12660 | 8/1992 |

* cited by examiner

DEVICE FOR USE IN BEVERAGE CONTAINERS

CROSS-REFERENCE TO RELATED APPLICATION(S)

This application claims the benefit of U.S. Provisional Application No. 61/638,372, filed Apr. 25, 2012, the contents of which are incorporated by reference in its entirety.

BACKGROUND OF THE INVENTION

1. Field of the Invention

The present invention is directed generally to systems and methods for consuming beverages, and more specifically, to systems and methods for facilitating drinking a beverage from a beverage container through a drinking straw without obstruction by objects in the beverage container.

2. Description of the Related Art

Drinking straws are conventionally known for use in consuming various beverages. Some beverages may include various objects, such as fruit, seeds, leaves, or other objects. For these such beverages, the objects present in the beverage may be drawn into the mouth of a user during use of the drinking straw, or at least drawn into the drinking straw to cause an obstruction. This may cause coughing or other discomfort for the user. Additionally, in the case where a drinking straw is clogged, the user's ability to consume the beverage freely is disrupted.

DETAILED DESCRIPTION OF THE INVENTION

Embodiments of the present invention are directed to systems and methods for isolating a bottom open end of a drinking straw from objects within a beverage container. Such objects may include fruit, leaves, seeds, etc. This allows users to consume the beverage through the drinking straw freely without obstruction from the objects. As can be appreciated, the devices disclosed herein are advantageous over traditional straining of a beverage to remove all of the objects by allowing the taste of the beverage and its aesthetics to be maintained. Additionally, beverages may be made relatively quickly by not requiring an additional straining step. Further, users may consume the beverage more quickly since there is unobstructed access through the drinking straw.

Figure 1:
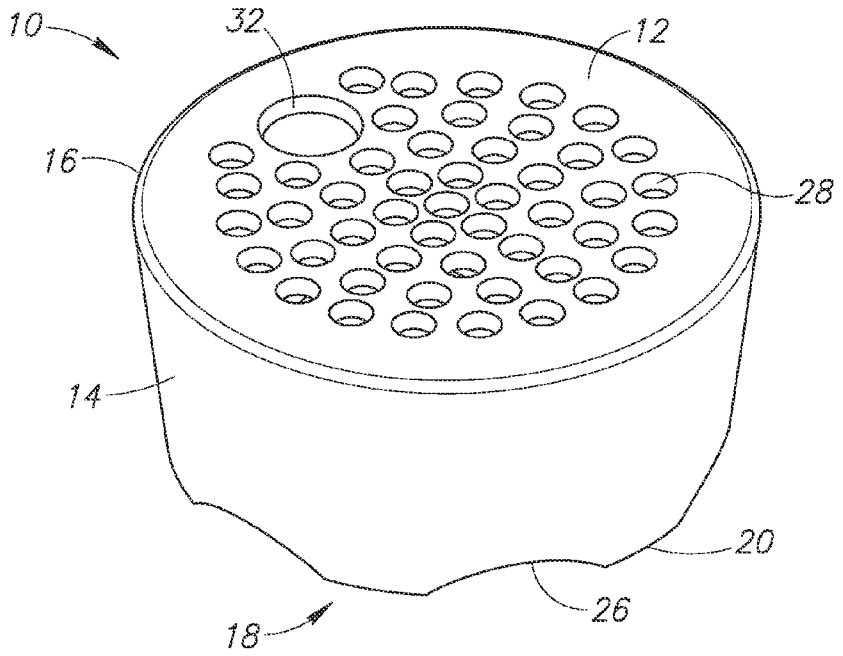
FIG. 1 is a top perspective view of a sieve according to an embodiment of the present invention.

FIGS. 1-11 illustrate various views of a sieve 10 (or generally, a "device") according to a first embodiment of the present invention. Referring first to FIG. 1, the sieve 10 comprises a disc-shaped top platform 12 supported by a circumferential sidewall 14 extending downward from the perimeter of the top platform. On an upper end, the sidewall 14 joins the top platform 12 at an exterior top edge 16. At the lower end, the sidewall 14 comprises a bottom edge 18 comprising a plurality of support edge portions 20 configured to support the sieve 10 in a bottom 22 of a drinking glass 24 (see FIG. 7). The bottom edge 18 of the sidewall 14 further includes a plurality of raised portions 26 or cutout portions sized to allow liquid to pass freely therethrough.

The top platform 12 comprises a plurality of filter openings 28 sized to allow liquid to flow therethrough but to restrict the passage of objects 30 (e.g., seeds, fruit, leaves, etc.) (see FIG. 8). For example, in cases wherein the filter openings 28 are circularly shaped, the filter openings may each have a diameter of about 0.05 inches to 0.15 inches (e.g., 0.1 inches), etc. The top platform 12 also comprises a drinking straw opening 32 positioned at an outer portion of the top platform substantially near the top edge 16. As discussed below, by positioning the drinking straw opening 32 at an outer portion of the top platform 12, a user is provided with a largely unobstructed surface on the top platform for manipulating objects the objects 30 (e.g., muddling or stirring objects).

Figure 2:
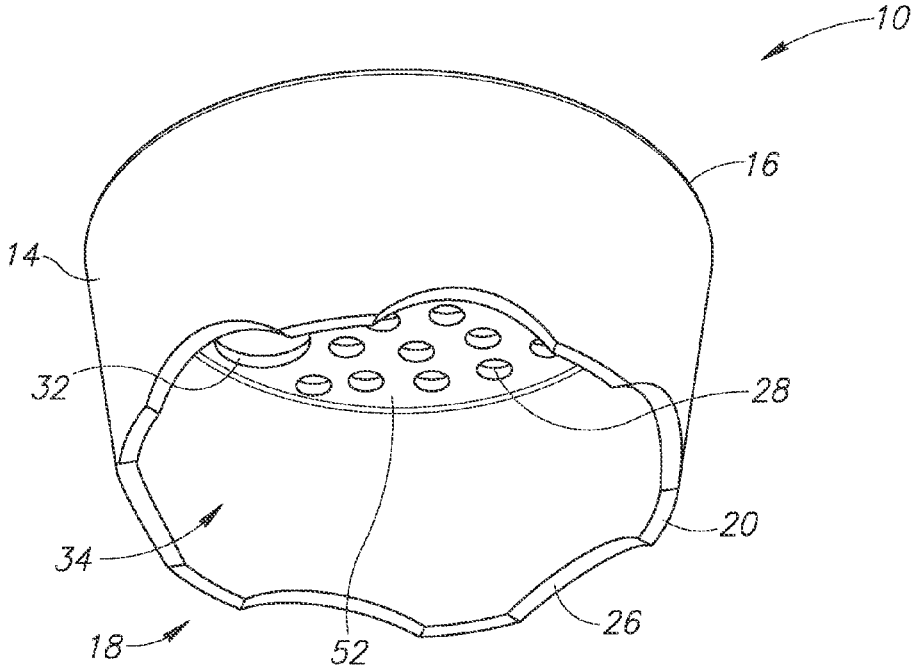
FIG. 2 is a bottom perspective view of the sieve of FIG. 1.
Figure 3:
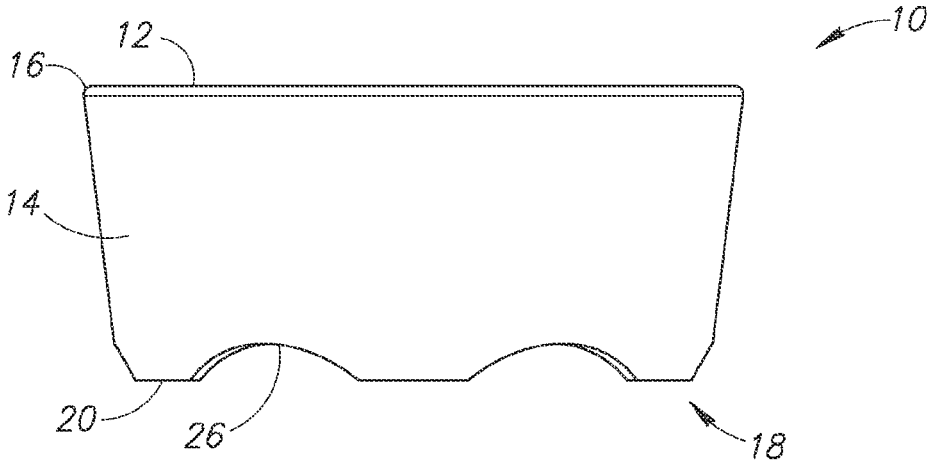
FIG. 3 is an elevational view of the sieve of FIG. 1.
Figure 4:
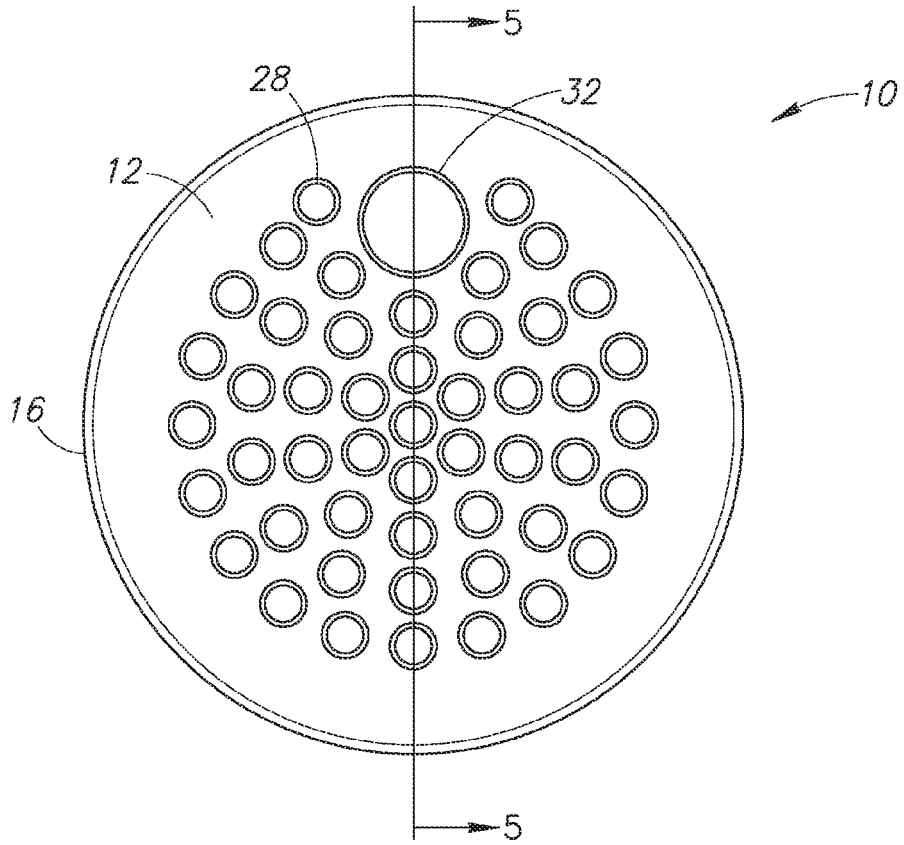
FIG. 4 top plan view of the sieve of FIG. 1.
Figure 5:
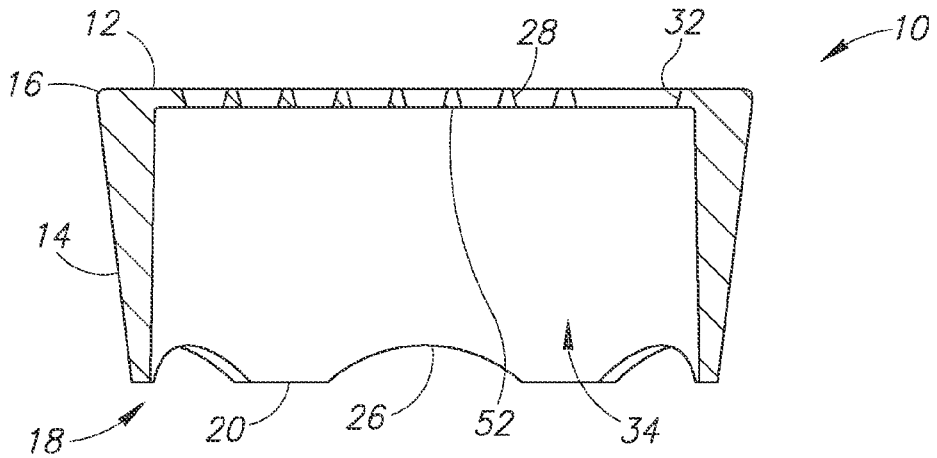
FIG. 5 is a cross-sectional view of the sieve taken substantially along the line 5-5 of FIG. 4.
Figure 6:
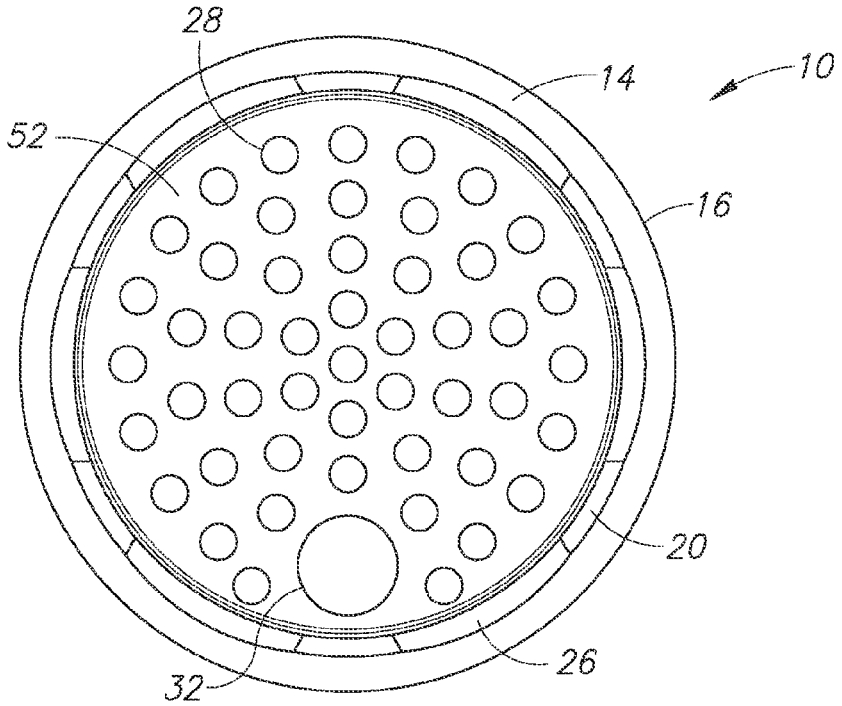
FIG. 6 is a bottom view of the sieve of FIG. 1.

As may best be seen in FIGS. 2 and 5, the top platform 12 and the sidewall 14 together form a cavity 34 having a downward facing open end. When the sieve 10 is positioned in the bottom 22 of the drinking glass 24, as shown in FIGS. 7-9, the bottom of the drinking glass acts as a lower border to the cavity 34 to provide a volume for a bottom open end 36 of a drinking straw 38 (see FIG. 9) that is isolated from the objects 30.

The sieve 10 may be formed from one or more suitable materials. In some embodiments, the sieve 10 is integrally formed from a single material. Non-limiting examples of suitable materials include clear or opaque polycarbonate and clear or opaque polypropylene. Preferably, the materials used are Bisphenol A (BPA) free.

Figure 8:
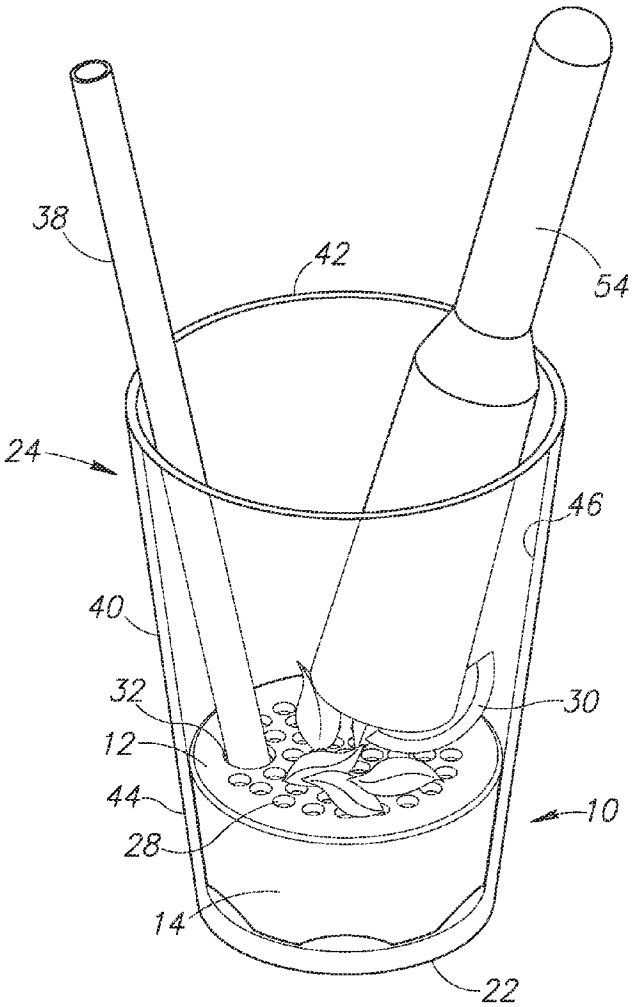
FIG. 8 is a perspective view of the sieve when positioned in the beverage container with objects placed in the beverage container.
Figure 7:
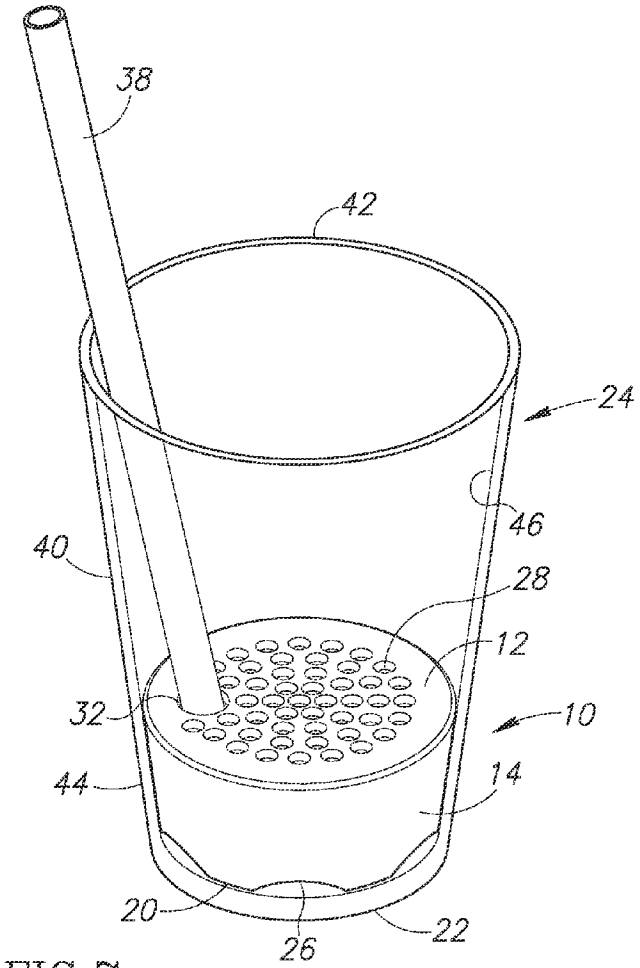
FIG. 7 is a perspective view of the sieve of FIG. 1 when positioned in a beverage container.
Figure 9:
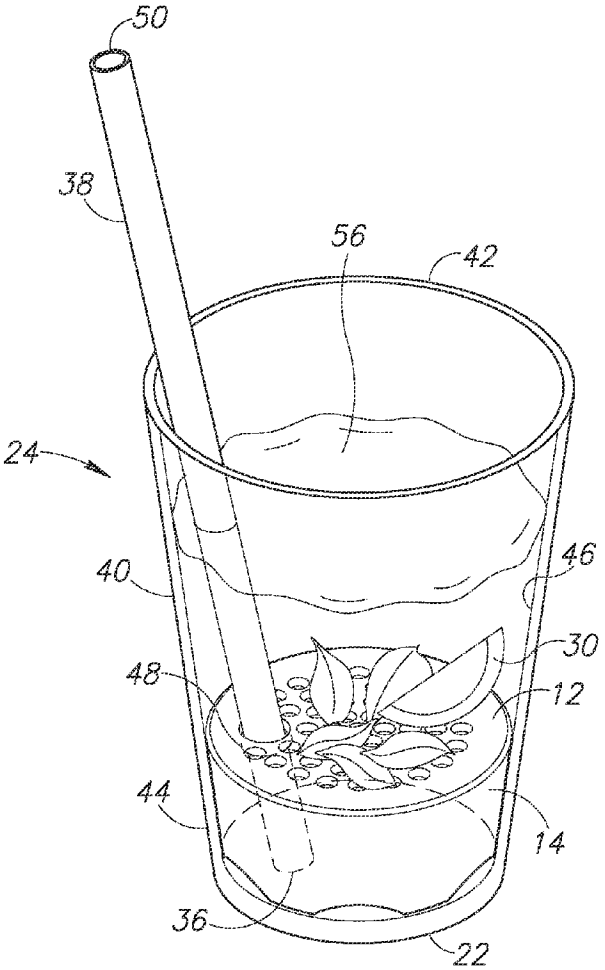
FIG. 9 is a perspective view of the sieve when positioned in the beverage container when the beverage container is filled with a liquid.

As shown in FIGS. 7-9, the sieve 10 is sized and shaped to be positioned within the drinking glass 24. The drinking glass 24 comprises a sidewall 40 extending between an upper rim 42 and the drinking glass bottom 22. The sidewall 14 and top platform 12 of the sieve 10 are sized to be slightly smaller than a lower sidewall portion 44 of the drinking glass 24, such that the sieve fits snugly within the bottom portion (e.g., is substantially adjacent thereto) of the drinking glass and is supported by the support edge portions 20 of the bottom edge 18 of the sieve. As can be appreciated, the cross-sectional area of the top platform 12 is slightly smaller than the cross-sectional area of an interior portion 46 (see FIG. 7) of the sidewall 40 of the drinking glass 24 at the predetermined height of the top platform. In other words, the outer top edge 16 of the sieve 10 is disposed substantially adjacent to the interior portion 46 of the sidewall 40 of the drinking glass 24. This configuration prevents the objects 30 from bypassing the filter openings 28 by traveling downward between the top edge 16 of the sieve 10 and the interior portion 46 of the sidewall 40 of the drinking glass 24 and into the cavity 34 through the raised portions 26 of the bottom edge 18 of the sieve.

It should be appreciated that the size and shape of the sieve 10 may be varied to accommodate different size drinking glasses. Further, although in this example the sieve 10 has a circular horizontal cross-section, in other embodiments the cross-section may be other shapes. As an example, the horizontal cross-section of the sieve could be square to accommodate a drinking glass having a square interior sidewall. More generally, the outer dimensions of the sieve may be configured to substantially match the inner dimensions of a bottom portion of a drinking glass. Additionally height of the sieve may be varied as desired.

Figure 11:
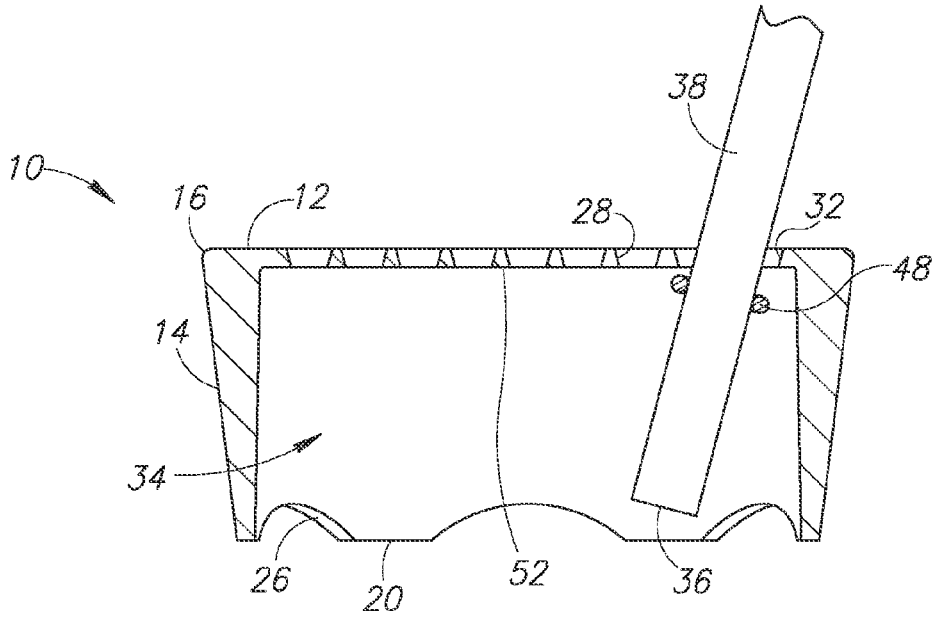
FIG. 11 is a cross-sectional view of a third embodiment of a sieve according to an embodiment of the present invention.

The use of the sieve 10 is now described. As shown in FIGS. 9 and 11, the drinking straw 38 includes a ring or ridge 48 fixedly attached to its body near the bottom open end 36 of the drinking straw. A user may first insert a top end 50 of the drinking straw 38 opposite the bottom end 36 into the cavity 34 from below and through the drinking straw opening 32 until the ridge 48 of the drinking straw contacts a downward facing bottom surface 52 (see FIG. 11) of the top platform 12. The ridge 48 of the drinking straw 38 has dimensions that are larger than the drinking straw opening 32 of the top platform 12 such that the ridge 48 is prohibited from passing through the drinking straw opening. As can be appreciated, the ridge 48 functions as a "lock" for the drinking straw 38 to prevent users from pulling the drinking straw up and out of the sieve 10 during use.

With the drinking straw 38 positioned in the drinking straw opening 32 and the bottom open end 36 of the drinking straw positioned within the cavity 34, the drinking straw and sieve 10 may be placed into the drinking glass 24 before any fruit or other objects 30, ice, or any liquid is added (see FIG. 7). Since the drinking straw 38 is already positioned within the drinking straw opening 32, the drinking straw opening is obstructed by the drinking straw, which prevents any objects 30 from passing through the drinking straw opening.

As shown in FIG. 8, one or more objects 30 may be inserted into the drinking glass 24 where they are positioned on and supported by the top platform 12. As discussed above, the filter openings 28 in the top platform 12 are sized to prevent the objects 30 from passing therethrough into the cavity 34. A user may use a muddler, pestle, or other tool 54 to manipulate the objects 30 on the top platform 12 before a liquid 56 (see FIG. 9) is added to the drinking glass 24. Next, as shown in FIG. 9, the liquid 56 may be added to the drinking glass 24. As shown, the objects 30 are retained on the top platform 12 while liquid 56 fills the cavity 34 through the filter openings 28 in the top platform and the raised portions 26 in the bottom edge 18 of the sidewall 14 of the sieve 10. Since the bottom open end 36 of the drinking straw 38 is positioned within the cavity 34 where there are no objects 30, a user may consume the liquid 56 using the drinking straw without obstruction by any of the objects.

Once the user has consumed the liquid 56 freely without obstruction by any objects 30, the user may then lift the sieve 10 out of the drinking glass 24 by simply lifting the drinking straw 38 upward which also moves the sieve 10 upward due to the ridge 48 of the drinking straw locking the drinking straw to the sieve. The user may then rinse or wash the drinking straw 38 and sieve 10 for reuse, or may discard the drinking straw and/or sieve if they are configured to be disposable.

Figure 10:
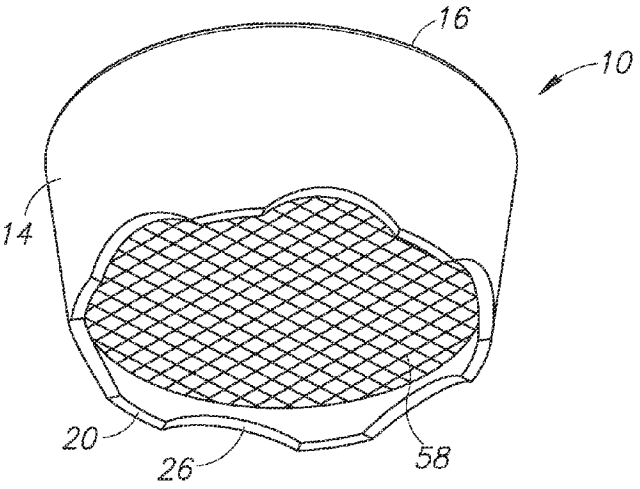
FIG. 10 is a bottom perspective view of a second embodiment of a sieve according to an embodiment of the present invention.

FIG. 10 illustrates an optional micro-screen mesh or filter 58 that in some embodiments may be positioned within the cavity 34 near the bottom edge 18 thereof. In these embodiments, the mesh 58 functions to provide additional filtering from below to prevent any objects 30 from entering the cavity 34 from near the bottom portion 22 of the drinking glass 24, such as through the raised portions 26 of the bottom edge 18 of the sieve 10.

Figure 15:
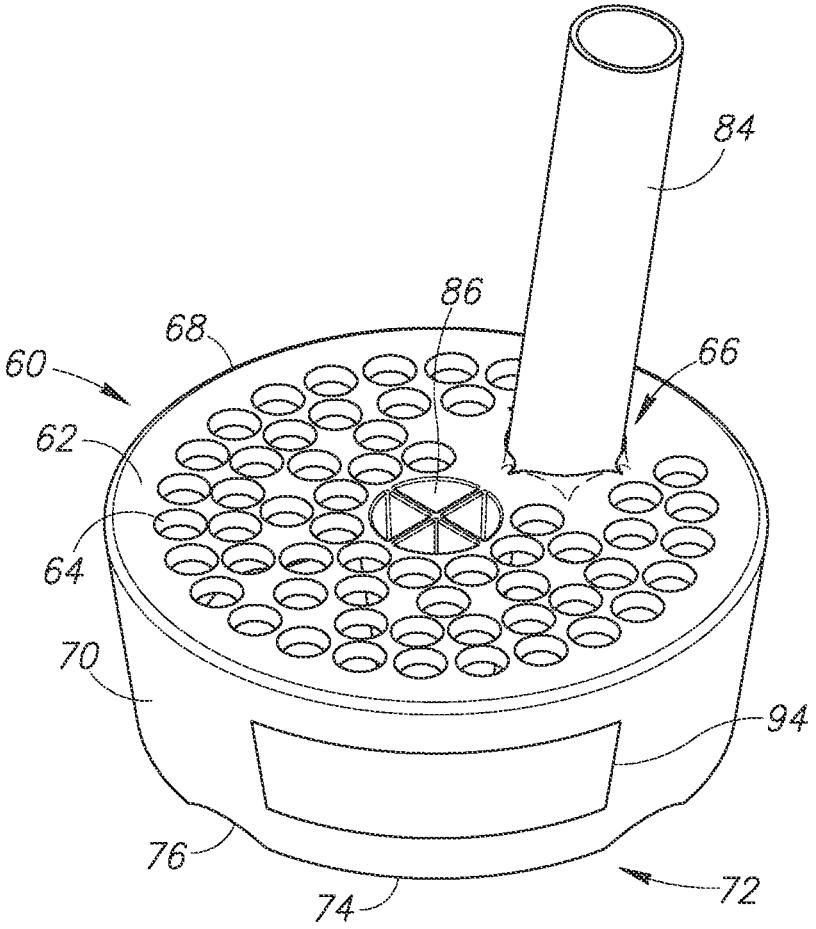
FIG. 15 is a top perspective view of the sieve of FIG. 12 when a drinking straw is positioned through a drinking straw opening of the sieve.

FIGS. 12-15 illustrate another embodiment of a sieve 60 according to the present invention. The sieve 60 is similar to the sieve 10 shown in FIGS. 1-11 in many aspects. The sieve 60 includes a top platform 62 having a plurality of filter openings 64 and a drinking straw opening 66 disposed near an outer edge 68 of the top platform 62. The sieve 60 also includes a sidewall 70 extending downward from the top platform 62 and terminating in a bottom edge 72 having support edge portions 74 and raised portions 76. A downward facing interior cavity 78 (see FIG. 13) is formed by the top platform 62 and the sidewall 70. In this embodiment, rather than a drinking straw opening that comprises a circular aperture, the drinking straw opening 66 of the sieve 60 comprises two intersecting cut lines 80 in the top platform 62 that form four flexible tabs or flaps 82. As shown in FIG. 15, the flaps 82 are sufficiently flexible such that when a drinking straw 84 is pressed downward onto the cut lines 80, the flaps 82 flex downward to permit the drinking straw to pass into the cavity 78. The flexibility of the flaps 82 may be controlled by varying the thickness of them (see FIG. 13). When the drinking straw 84 is positioned within the cavity 78, the flaps 82 are flexed downward and exert an inward force on the drinking straw to help prevent the drinking straw from being removed from the cavity (e.g. by floating upward in a liquid). Other mechanisms may be used to assist with retaining the drinking straw 84 within the cavity 78. For example, in some embodiments a ring of flexible material (e.g., rubber) is positioned on an interior wall of a drinking straw opening. The ring of material may be slightly smaller than the diameter of the drinking straw 84, such that the ring retains the drinking straw in a fixed position by exerting a small inward force on the drinking straw.

Figure 12:
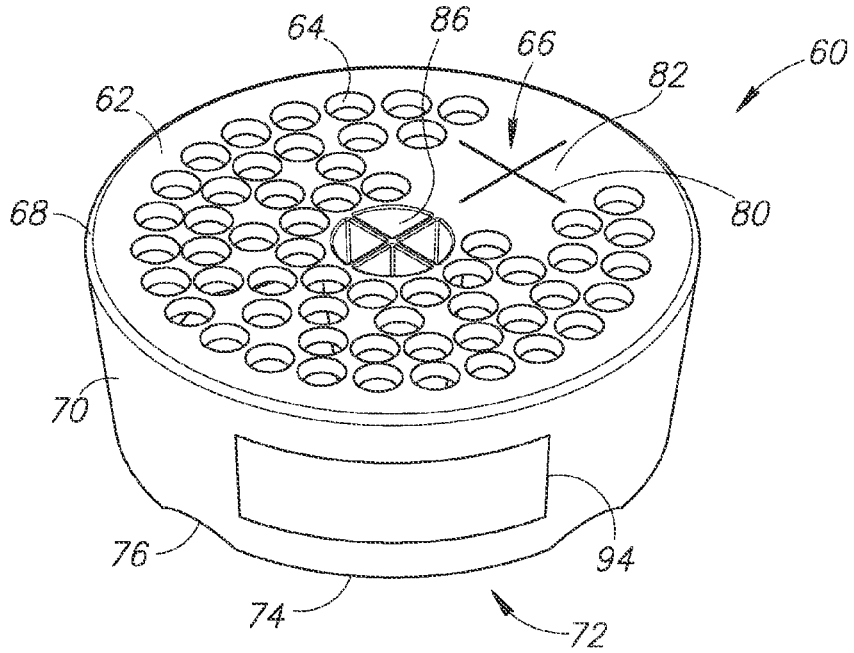
FIG. 12 is a top perspective view of a fourth embodiment of a sieve according to an embodiment of the present invention.
Figure 13:
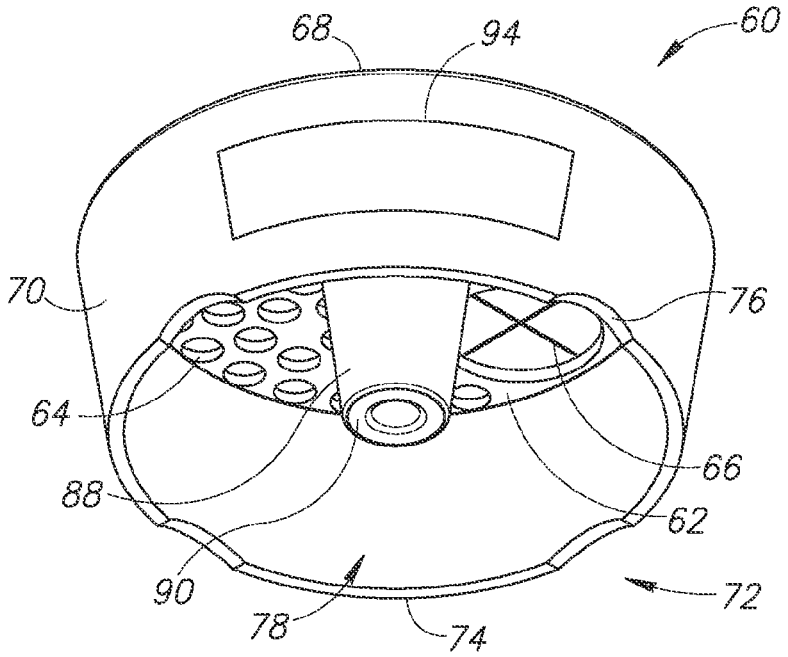
FIG. 13 is a bottom perspective view of the sieve of FIG. 12.
Figure 14:
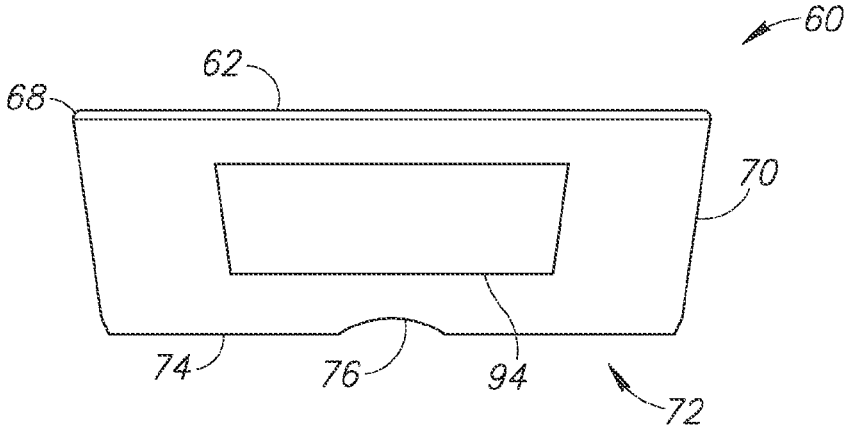
FIG. 14 is an elevational view of the sieve of FIG. 12.

As shown in FIGS. 12 and 13 the sieve 60 also includes a centrally located hollow well or cavity 86 comprising a sidewall 88 (see FIG. 13) extending from the top platform 62 downward to a well base 90 that is substantially horizontally aligned with the support edge portions 74 of the bottom edge 72 of the sieve 60. When the sieve 60 is placed in a drinking glass, the well base 90 is in contact with the interior bottom surface of the drinking glass such that the hollow well 86 provides support for the top platform 62 in the center thereof. By providing support in this central region of the top platform 62, the sieve 60 is able to withstand greater downward forces that may be applied to the top platform during preparation of a beverage. For example, if a user is muddling objects position on the top platform 62, the additional support provided by the hollow well 86 may be desirable. In addition to providing support, the hollow well 86 also functions to reduce the buoyancy of the sieve 60. Once a drinking glass in which the sieve 60 is positioned is filled with a liquid, the hollow well 86 fills with liquid, which reduces the buoyancy of the sieve and helps prevent it from floating towards the top of the drinking glass.

As shown in FIGS. 12-15, the sidewall 70 of the sieve 60 includes a logo or advertisement 94 positioned thereon. As will be appreciated the sieve 10 discussed above may also include a logo or advertisement. In many cases, the drinking glass used with the sieve 60 may be formed from clear glass or clear plastic, such that the sieve is visible to users while consuming a beverage. Thus, the logo or advertisement 94 positioned on the sidewall 70 is readily visible to users. The logo or advertisement 94 may comprise one or more graphics and/or text positioned at any location on the sieve 60. The logo or advertisement 94 may be associated with any entity. For example, the logo or advertisement 94 may be associated with the manufacturer or vendor of the sieve 60, a brand of beverage, the venue at which the sieve is used, etc.

It should be appreciated that the structure of the sieves 10 and 60 allow them to also perform as beverage infusers. In this function, the top platform serves to isolate the material being steeped or brewed from the cavity in which the bottom open end of the drinking straw is positioned. The material may include tea leaves, herbs, or any other material suitable to be used with a beverage infuser.

As will be appreciated, the embodiments of the present invention described herein provide several advantages. By isolating the bottom open end of the drinking straw from any objects in a beverage, uses are able to consume the beverage freely without obstruction. Additionally, objects may be left inside the drinking glass during consumption of the beverage by the user. This improves the speed in which users may prepare a beverage by not requiring straining of the beverage into a separate drinking glass. Further, leaving the objects inside the beverage during consumption may be aesthetically pleasing and may also improve the taste of the beverage. Those skilled in the art will appreciate other advantages provided by the embodiments of the present invention.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediary components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A device positionable within a beverage container to facilitate consumption of a liquid therein through a drinking straw, the device comprising:

a top muddling platform having a drinking straw opening and a plurality of filter openings therein, the top muddling platform being configured to support objects placed in the beverage container, the drinking straw opening being sized to allow an end of the drinking straw to pass therethrough and being sized to prohibit the objects from passing therethrough when the drinking straw is inserted through the drinking straw opening, and the plurality of filter openings being sized to prohibit the objects from passing therethrough and to allow the liquid to pass therethrough;

a sidewall having a length extending downward from a perimeter of the top muddling platform and a sidewall thickness less than the length, the length of the sidewall being configured to contact an interior bottom surface of the beverage container to support the top muddling platform at a predetermined height above the interior bottom surface of the beverage container such that the drinking straw may be positioned through the drinking straw opening and a bottom open end of the drinking straw is positioned below the top muddling platform to allow a user to consume a liquid in the beverage container through the drinking straw while the objects are retained above the top muddling platform on the top muddling platform; and a support member positioned toward the center of the top muddling platform having elongated support member sidewalls with a length extending downward from the top muddling platform to a closed base portion disposed below a bottom surface of the top muddling platform, the support member having an inner cavity extending downwardly between the support member sidewalls from an open upper end in the center of the top muddling platform and terminating below the bottom surface of the top muddling platform, the support member being configured to contact the interior bottom surface of the beverage container to support the top muddling platform when a downward force is exerted on the top muddling platform.

2. The device of claim 1, wherein the drinking straw opening is offset from a center of the top muddling platform and positioned adjacent to a peripheral edge of the top muddling platform.

3. The device of claim 1, wherein the objects comprise at least one of fruit and leaves.

4. The device of claim 1, wherein the top muddling platform is sized to substantially match an interior sidewall surface of the beverage container at the predetermined height, such that the perimeter of the top muddling platform is positioned substantially adjacent to the interior sidewall surface of the beverage container.

5. The device of claim 4, wherein the sidewall is sized to substantially match the size of the interior bottom surface of the beverage container such that at least a portion of the sidewall is positioned substantially adjacent to an interior sidewall surface of the beverage container at a location adjacent to the interior bottom surface of the beverage container.

6. The device of claim 1, wherein each of the filter openings is circularly shaped and has a diameter of between 0.05 inches and 0.15 inches.

7. The device of claim 1, wherein the top muddling platform, the support member, and the sidewall comprise a monolithic member.

8. The device of claim 1, wherein the top muddling platform and the sidewall are formed from one of polycarbonate and polypropylene.

9. The device of claim 1, further comprising a logo or advertisement located on at least the sidewall.

10. The device of claim 1, wherein the sidewall comprises a downwardly extending cylinder having a circular horizontal cross-section enclosing a liquid cavity below the top muddling platform and the cylinder terminating at a circular bottom edge comprising at least one support edge portion and at least one raised edge portion, the support edge portion of the circular bottom edge being a lowermost edge of the cylinder and being configured to contact the interior bottom surface of the beverage container, and the at least one raised edge portion being a raised edge along the circumference of the circular bottom edge that is raised above the at least one support edge portion such that the liquid may pass under the raised edge portion and into the liquid cavity.

11. A system for facilitating consumption of a liquid within a beverage container, the system comprising:

a drinking straw having a drinking straw body terminating in a top open end and a bottom open end, the drinking straw further comprising ridge portion fixedly positioned near the bottom open end of the drinking straw body having a larger horizontal dimension than the horizontal dimension of the drinking straw body; and a device comprising:

a top muddling platform having a drinking straw opening and a plurality of filter openings therein, the drinking straw opening being sized to permit passage of the drinking straw body and to prohibit passage of the ridge portion of the drinking straw, the top muddling platform being configured to support objects placed in the beverage container, the drinking straw opening being sized to allow an end of the drinking straw to pass therethrough and being sized to prohibit the objects from passing therethrough when the drinking straw is inserted through the drinking straw opening, and the plurality of filter openings being sized to prohibit the objects from passing therethrough and to allow the liquid to pass therethrough;

a sidewall having a length extending downward from the top muddling platform and a sidewall thickness less than the length, the sidewall being configured to support the top muddling platform at a predetermined height above a bottom interior surface of the beverage container such that the drinking straw may be positioned through the drinking straw opening from below and the bottom open end of the drinking straw is positioned below the top muddling platform to allow the user to consume a liquid in the beverage container through the drinking straw while the objects are retained above the top muddling platform; and a support member positioned toward the center of the top muddling platform having elongated support member sidewalls with a length extending downward from the top muddling platform to a closed base portion disposed below a bottom surface of the top muddling platform, the support member having an inner cavity extending downwardly between the support member sidewalls from an open upper end in the center of the top muddling platform and terminating below the bottom surface of the top muddling platform, the support member being configured to contact the interior bottom surface of the beverage container to support the top muddling platform when a downward force is exerted on the top muddling platform.

12. The system of claim 11, wherein the drinking straw opening is offset from a center of the top muddling platform and positioned adjacent to a peripheral edge of the top muddling platform.

13. The system of claim 11, wherein the top muddling platform is sized to substantially match an interior sidewall surface of the beverage container at the predetermined height, such that the perimeter of the top muddling platform is positioned substantially adjacent to the interior sidewall surface of the beverage container.

14. The system of claim 13, wherein the sidewall is sized to substantially match the size of the interior bottom surface of the beverage container such that at least a portion of the sidewall is positioned substantially adjacent to an interior sidewall surface of the beverage container at a location adjacent to the interior bottom surface of the beverage container.

15. The system of claim 11, wherein the top muddling platform and the sidewall are formed from one of polycarbonate and polypropylene.

16. The system of claim 11, further comprising a logo or advertisement located on the sidewall.

17. The system of claim 11, wherein the sidewall comprises a downwardly extending cylinder having a circular horizontal cross-section enclosing a liquid cavity below the top muddling platform and the cylinder terminating at a circular bottom edge comprising at least one support edge portion and at least one raised edge portion, the support edge portion of the circular bottom edge being a lowermost edge of the cylinder and being configured to contact the interior bottom surface of the beverage container, and the at least one raised edge portion being a raised edge along the circumference of the circular bottom edge that is raised above the at least one support edge portion such that the liquid may pass under the raised edge portion and into the liquid cavity.

* * * * *